US006733603B1

(12) United States Patent
Wu et al.

(10) Patent No.: US 6,733,603 B1
(45) Date of Patent: May 11, 2004

(54) COBALT-BASED INDUSTRIAL CUTTING TOOL INSERTS AND ALLOYS THEREFOR

(75) Inventors: James B. C. Wu, St. Louis, MO (US); Bradley McKee, Belleville (CA); Ian Purvis, Belleville (CA)

(73) Assignee: Deloro Stellite Company, Inc., St. Louis, MO (US)

( * ) Notice: Subject to any disclaimer, the term of this patent is extended or adjusted under 35 U.S.C. 154(b) by 181 days.

(21) Appl. No.: 09/713,562

(22) Filed: Nov. 15, 2000

Related U.S. Application Data

(60) Provisional application No. 60/165,549, filed on Nov. 15, 1999.

(51) Int. Cl.[7] ..... C22C 19/07; B23P 15/28

(52) U.S. Cl. ..... 148/425; 420/435; 420/436; 407/119

(58) Field of Search ..... 148/425; 420/435, 420/436; 407/119

(56) References Cited

U.S. PATENT DOCUMENTS

| | | | | | |
|---|---|---|---|---|---|
| RE28,552 | E | * | 9/1975 | Smith | 148/425 |
| 4,556,607 | A | * | 12/1985 | Sastri | 428/627 |
| 4,692,305 | A | * | 9/1987 | Rangaswamy et al. | 420/436 |
| 4,714,468 | A | * | 12/1987 | Wang et al. | 623/16 |
| 5,002,731 | A | * | 3/1991 | Crook et al. | 420/440 |
| 5,462,575 | A | * | 10/1995 | Del Corso | 75/243 |

FOREIGN PATENT DOCUMENTS

| | | | | | |
|---|---|---|---|---|---|
| JP | 62-136544 | A | * | 6/1987 | C22C/19/07 |
| JP | 62-136546 | A | * | 6/1987 | C22C/19/07 |
| JP | 01-096350 | A | * | 4/1989 | C22C/19/07 |
| JP | 03-146631 | A | * | 6/1991 | C22C/19/07 |
| JP | 07-179967 | A | * | 7/1995 | C22C/19/07 |
| JP | 09-020946 | A | * | 1/1997 | C22C/19/07 |
| JP | 10-030141 | A | * | 2/1998 | C22C/19/07 |
| JP | 10-204564 | A | * | 8/1998 | C22C/19/07 |

OTHER PUBLICATIONS

Davis et al, editors, "Nickel, Cobalt, and Their Alloys", 2000, ASM International, pp. 347, 354, 362, 363, 365.*

Eric Stephenson, Circular Saws, Jan. 1972, pp. 76–77 and 95–111.

* cited by examiner

*Primary Examiner*—Roy King
*Assistant Examiner*—Harry D. Wilkins, III
(74) *Attorney, Agent, or Firm*—Senniger, Powers, Leavitt & Roedel

(57) ABSTRACT

Co-based cutting tool insert alloys having a wrought microstructure and 3–15% Mo, 25–35% Cr, 0.5–2.5% C. The presence of W is avoided, and held below 1%. The alloys have enhanced resistance to abrasive and corrosive attack, and are especially suited for manufacturing router bits, router cutters, shaper cutters, molder cutters, etc. for cutting wood in secondary cutting operations such as furniture making or other cutting inserts such as inserts for cutting optical fibers.

17 Claims, 1 Drawing Sheet

COBALT-BASED INDUSTRIAL CUTTING TOOL INSERTS AND ALLOYS THEREFOR

CROSS-REFERENCE TO RELATED APPLICATION

This application claims priority from provisional application No. 60/165,549 filed Nov. 15, 1999.

BACKGROUND OF THE INVENTION

This invention is directed to alloys for industrial cutting tools, especially the variety of tools known as cutting inserts, where enhanced resistance to abrasion and corrosion, especially in acidic environments of a reducing nature, are required, as well as toughness. One particular application relates to cutting optical fibers, where corrosive chlorides are present; another particular application relates to cutting wood in secondary operations such as furniture manufacture, where abrasive glues and the like are present.

Heretofore industrial cutting tool inserts have been made from a variety of materials including tool steels as well as sintered tungsten carbide materials. When cutting is done in a corrosive medium, highly alloyed, corrosion-resistant materials are required to prevent the cutting edge from deteriorating. One commercially available alloy, Stellite 6K, is often used in such environments. This alloy is cobalt based with a hardness of HRC 44–47 in the fully annealed condition. Because this alloy is made by hot rolling, it also possesses a high toughness. This alloy has been selected for industrial cutting tool applications due to its combination of hardness and toughness in addition to its corrosion resistance. One disadvantage of Stellite 6K has been its susceptibility to attack in strongly corrosive media and also under certain abrasive conditions.

Sintered tungsten carbide materials have often been selected over Stellite 6K in severe abrasive conditions. If corrosion is involved as well, a commercially available cobalt based alloy called Tangtung G is chosen. A cutting tool made of Tangtung G is produced by chill casting. No wrought version of this alloy is commercially available. A wrought microstructure is preferred over a cast microstructure in high performance cutting tools.

SUMMARY OF THE INVENTION

Among the objects of this invention, therefore, are to provide an alloy for industrial cutting tools which has enhanced corrosion resistance in strongly corrosive media; to provide such an alloy having enhanced abrasion resistance; to provide such an alloy having a wrought microstructure; to provide such an alloy having resistance to acidic environments of a reducing nature; and to provide such an alloy which avoids internal additions of tungsten.

Briefly, therefore, the invention is directed to a cobalt-based alloy for forming industrial cutting tool inserts, the alloy having a wrought microstructure, improved resistance to corrosion and abrasive wear and comprising from about 3% to about 15% by weight Mo and no more than 1% by weight W.

The invention is also directed to a cobalt-based alloy for forming industrial cutting tools for use in acidic environments of a reducing nature, the alloy having a wrought microstructure and consisting essentially of, by approximate weight percent:

| | |
|---|---|
| C | 0.5–2.5 |
| Cr | 25–35 |
| Mo | 3–15 |
| W | no more than 1 |
| Ta + Nb + V + Ti | up to 6 |
| Mn + Si + Ni + Fe | no more than 10 |
| Co | Balance. |

In another aspect the invention is directed to a cobalt-based alloy for forming industrial cutting tool inserts for cutting optical fibers, the alloy having a wrought microstructure, enhanced resistance to chloride corrosion, and consisting essentially of, by approximate weight percent:

| | |
|---|---|
| C | 0.5–2.5 |
| Cr | 25–35 |
| Mo | 3–15 |
| W | no more than 1 |
| Ta + Nb + V + Ti | up to 6 |
| Mn + Si + Ni + Fe | no more than 10 |
| Co | Balance |

with the microstructure being characterized by banding and occasional twinning, with grains having a grain size larger than 20 microns constituting at least 20% of the alloy's volume and with grains having a grain size smaller than 5 microns constituting at least 20% of the alloy's volume.

The invention is also directed to industrial cutting tool inserts constructed from the foregoing alloys.

Other objects and features of the invention will be in part apparent and in part pointed out hereinafter.

DETAILED DESCRIPTION OF THE INVENTION

This invention relates to the formulation of Co-based alloys to achieve the desired properties for making industrial cutting tools.

It has been discovered that the formation of finely dispersed molybdenum carbide particles is advantageous in a tough, corrosion resistant cobalt-based alloy matrix. The alloys of the invention contain molybdenum in amounts between about 3% and about 15% by weight. In one preferred embodiment the Mo content is between about 3% and about 8% by weight.

The alloys of the invention contain substantially no intentional additions of tungsten, although tungsten is present in some trace amounts in scrap materials optionally used to formulate such alloys. As such, the tungsten content is preferably limited to no more than 1% by-weight, more preferably to no more than about 0.5% by weight, and most preferably no more than about 0.2% by weight. In one especially preferred embodiment, tungsten is entirely eliminated. Tungsten is minimized in order to minimize the internal stresses induced by the large tungsten atoms, which tend to remain in solid solution instead of forming tungsten carbide due to tungsten's sluggish diffusion rate.

Chromium is provided in order to enhance corrosion resistance. The chromium content is preferably in the range of 25 to 35% by weight. One preferred embodiment employs chromium in the range of 27 to 32% by weight.

Carbon is provided in a quantity sufficient to yield the desired molybdenum-containing carbides. The carbon content is preferably in the range of from about 0.5 to about 2.5% by weight. In one preferred embodiment, the carbon content is between about 1.0 and 2.0% by weight.

In one preferred embodiment, the invention is directed to alloys having the following approximate composition, by weight percent:

| | |
|---|---|
| C | 0.5–2.5 |
| Cr | 25–35 |
| Mo | 3–15 |
| W | Less than 1 |
| Co | Balance |

In a further preferred embodiment, the invention is directed to alloys having the following approximate composition, by weight percent:

| | |
|---|---|
| C | 1.0–2.0 |
| Cr | 27–32 |
| Mo | 3–8 |
| W | Less than 1 |
| Co | Balance |

In each of the foregoing compositions, other elements such as Mn, Si, Ni, and Fe may be present as impurities or intentional additions for improving hot rolling characteristics. The maximum amount of these elements in combination is preferably held below about 10% by weight, more preferably below about 7% by weight.

Carbide forming elements, such as Ta, Nb, V and Ti in amounts totaling less than about 6% may also be added for enhancing abrasion resistance.

Figure 1:
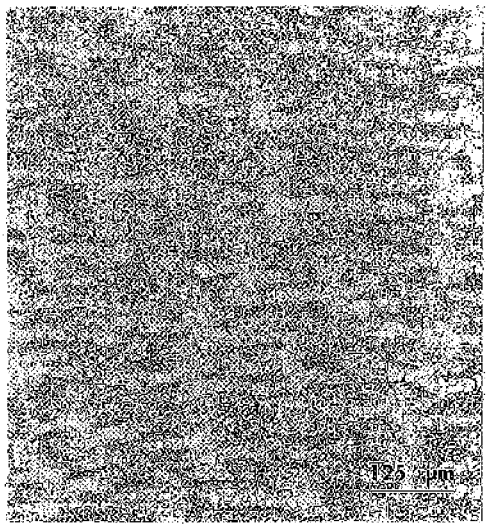
FIG. 1 is a metallographic photomicrograph at 120× of the alloy of the invention.
Figure 2:
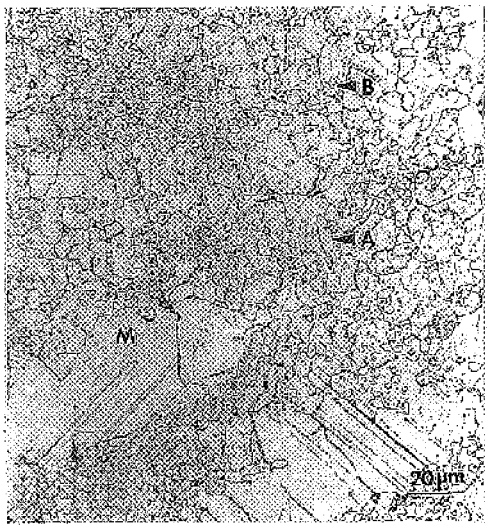
FIG. 2 is a metallographic photomicrograph at 480× of the alloy of the invention.

The alloys of the invention are hot rolled or otherwise wrought. This imparts them with a wrought microstructure of greater toughness, yield strength, ductility, and impact resistance. The alloys are, for example, hot-rolled into a long sheet or plate and then individual cutting tool inserts are cut out of the rolled form by laser cutting or the like. The inserts formed thereby can be any of a variety of shape of router bits, router cutters, shaper cutters, molder cutters, etc. for cutting wood or other cutting inserts such as inserts for cutting optical fibers. In metallographic examination, as in FIGS. 1 and 2, it is observed that the alloy has a banded structure, with many large grains interspersed with a number of substantially smaller grains, and a quantity of twins. In particular, at least about 20% of the alloy volume is composed of grains having a grain size of greater than about 20 microns, and at least about 20% of the alloy volume is composed of grains having a grain size of less than about 5 microns, which provides a unique combination of toughness and abrasion resistance critical to the efficacy of the invention. There is a second phase (A) and an occasional third phase (B) inside the second phase. There are large grains without any presence of carbides. It is believed that this combination in the microstructure brings about the unique properties of the invention.

EXAMPLE 1

The following table compares the chemical compositions of Alloys A through C of the invention with the prior art cobalt-based alloys:

| | C | Cr | Mo | W | Ta or Nb | Ni | Fe | Hardness HRC |
|---|---|---|---|---|---|---|---|---|
| Alloy A | 1.5 | 29 | 3.1 | 0.6 | — | 2.3 | 2.8 | 45 |
| Alloy B | 1.4 | 29 | 5.9 | 0.4 | — | 1.5 | 1.4 | 46 |
| Alloy C | 1.3 | 28 | 5.6 | 0.04 | — | 2.1 | 1.5 | 44 |
| Alloy 6K | 1.6 | 29 | — | 4.5 | — | 1.5 | 1.5 | 46 |
| Tangtung G | 2.0 | 28 | 2.0 | 16 | 5.0 | — | 2.0 | 48 |

Alloys A, B and C do not have any intentional additions of tungsten. Inasmuch as tungsten atoms are relatively large, tungsten is minimized in order to minimize the internal stresses induced by the large tungsten atoms, which tend to remain in solid solution instead of forming tungsten carbide due to tungsten's sluggish diffusion rate. It has been discovered that the molybdenum addition in Alloy A promotes the formation of molybdenum carbide particles for enhancing abrasion resistance and corrosion resistance, especially in acidic environments of a reducing nature.

EXAMPLE 2

An ingot of Alloy A was successfully hot rolled into sheets of 4 mm thick. Corrosion and abrasion tests were performed comparing Alloy A with Stellite 6K. The weight loss results in millimeters per year are shown below:

| Media | Condition | Test Period | Stellite 6K | Alloy A |
|---|---|---|---|---|
| HCl | 2.5% Boiling | 48 hours | 189 | 128 |
| | 5% Boiling | 48 hours | 488 | 161 |
| | 10% Boiling | 48 hours | Dissolved | 171 |
| HNO3 | 10% Boiling | 72 hours | 2.9 | 0.09 |
| H2SO4 | 10% 65C | 48 hours | 47 | 0.04 |
| ASTM G48 | 6% $FeCl_3$ Room Temp | 72 hours | Pitting | No Pitting |

The above results indicate that Alloy A has better corrosion resistance than Stellite 6K in all the corrosive media tested.

EXAMPLE 3

Abrasion resistance was also tested using the standard ASTM G65, Procedure B, to compare Alloy A to Stellite 6K and to hardened D2 tool steel. D2 tool steel has the following formulation: C 1.55, Cr 11.5, Mo 0.9, V 0.8 and balance iron. In these tests, Alloy A exhibited a wear loss of 6.8 $mm^3$/2000 revolutions versus 13.3 $mm^3$ for Stellite 6K and 12 $mm^3$ for tool steel D2. Alloy A was therefore found having significant improvement in abrasion resistance over Stellite 6K. Compared to tool steel D2, which has a high hardness of HRC 60, Alloy A is also significantly more abrasion resistant.

As various changes could be made in the above embodiments without departing from the scope of the invention, it is intended that all matter contained in the above description shall be interpreted as illustrative and not in a limiting sense.

What is claimed is:

1. A cobalt-based, industrial cutting tool insert alloy formed by hot working having a wrought microstructure, resistance to corrosion and abrasive wear, and comprising from about 3% to about 15% by weight Mo and no more than 1% by weight W.

2. The alloy of claim 1 comprising essentially no W.

3. The alloy of claim 1 comprising from about 0.5% to about 2.5% by weight C, and from about 25% to about 35% by weight Cr.

4. The alloy of claim 3 consisting essentially of, by approximate weight percent:

C 0.5–2.5

Cr 25–35

Mo 3–15

W no more than 1

Ta+Nb+V+Ti up to 6

Mn+Si+Ni+Fe no more than 10

Co Balances.

5. The alloy of claim 4 consisting essentially of, by weight percent:

C 1.0–2.0

Cr 27–32

Mo 3–8

W no more than 1

Ta+Nb+V+Ti up to 6

Mn+Si+Ni+Fe no more than 10

Co Balance.

6. The alloy of claim 5 consisting essentially of no W.

7. The cobalt-based alloy of claim 5 which exhibits abrasive wear of less than about 10 mm3/2000 revolutions under ASTM standard G65, Procedure B.

8. A cobalt-based, industrial cutting tool insert alloy formed by hot working having a wrought microstructure, resistance to corrosion and abrasive wear, and comprising from about 3% to about 15% by weight Mo and no more than 1% by weight W;

wherein grains having a grain size larger than 20 microns constitute at least 20% of the alloy's volume and grains having a grain size smaller than 5 microns constitute at least 20% of the alloy's volume.

9. The alloy of claim 8 wherein said microstructure is characterized by banding and occasional twinning.

10. A cobalt-based industrial cutting tool insert alloy formed by hot working for use in acidic environments of a reducing nature, the alloy having a wrought microstructure and consisting essentially of, by approximate weight percent:

C 0.5–2.5

Cr 25–35

Mo 3–15

W no more than 1

Ta+Nb+V+Ti up to 6

Mn+Si+Ni+Fe no more than 10

Co Balance.

11. A cobalt-based industrial cutting tool insert alloy formed by hot working for use in acidic environments of a reducing nature, the alloy having a wrought microstructure and consisting essentially of, by approximate weight percent:

C 0.5–2.5

Cr 25–35

Mo 3–15

W no more than 1

Ta+Nb+V+Ti up to 6

Mn+Si+Ni+Fe no more than 10

Co Balance;

wherein grains having a grain size larger than 20 microns constitute at least 20% of the alloy's volume and grains having a grain size smaller than 5 microns constitute at least 20% of the alloy's volume.

12. The alloy of claim 11 wherein said microstructure is characterized by banding and occasional twinning.

13. A cobalt-based industrial cutting tool insert alloy formed by hot working for forming industrial cutting tool inserts for cutting optical fibers, the alloy having a wrought microstructure, resistance to chloride corrosion, and consisting essentially of, by approximate weight percent:

C 0.5–2.5

Cr 25–35

Mo 3–15

W no more than 1

Ta+Nb+V+Ti up to 6

Mn+Si+Ni+Fe no more than 10

Co Balance said microstructure being characterized by banding and occasional twinning, with grains having a grain size larger than 20 microns constituting at least 20% of the alloy's volume and with grains having a grain size smaller than 5 microns constituting at least 20% of the alloy's volume.

14. An industrial cutting tool insert comprising a cutting tool insert shape constructed from a hot worked alloy having a wrought microstructure, resistance to corrosion and abrasive wear, and comprising from about 3% to about 15% by weight Mo, no more than 1% by weight W, and the balance by weight Co.

15. The industrial cutting tool insert of claim 14 wherein the alloy has a wrought microstructure and consists essentially of, by approximate weight percent:

C 0.5–2.5

Cr 25–35

Mo 3–15

W no more than 1

Ta+Nb+V+Ti up to 6

Mn+Si+Ni+Fe no more than 10

Co Balance.

16. The industrial cutting tool insert of claim 15 wherein the alloy consists essentially of, by weight percent

C 1.0–2.0

Cr 27–32

Mo 3–8

W no more than 1

Ta+Nb+V+Ti up to 6

Mn+Si+Ni+Fe no more than 10

Co Balance.

17. An industrial cutting tool insert constructed from a hot worked alloy having a wrought microstructure, resistance to corrosion and abrasive wear, and consisting essentially of, by approximate weight percent:

C 0.5–2.5

Cr 25–35

Mo 3–15

W no more than 1

Ta+Nb+V+Ti up to 6

Mn+Si+Ni+Fe no more than 10

Co Balance;

wherein the alloy microstructure is characterized by banding and occasional twinning, with grains having a grain size larger than 20 microns constituting at least 20% of the alloy's volume and with grains having a grain size smaller than 5 microns constituting at least 20% of the alloy's volume.

* * * * *